US009310116B2

(12) United States Patent
Culley et al.

(10) Patent No.: US 9,310,116 B2
(45) Date of Patent: Apr. 12, 2016

(54) ICE STORAGE TO HOLD ICE AND MINIMIZE MELTING OF ICE SPHERES

(71) Applicant: Whirlpool Corporation, Benton Harbor, MI (US)

(72) Inventors: Brian K. Culley, Evansville, IN (US); Lindsey Ann Wohlgamuth, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 540 days.

(21) Appl. No.: 13/679,199

(22) Filed: Nov. 16, 2012

(65) Prior Publication Data

US 2014/0137576 A1 May 22, 2014

(51) Int. Cl.
*F25C 5/02* (2006.01)
*F25C 5/18* (2006.01)

(52) U.S. Cl.
CPC . *F25C 5/18* (2013.01); *F25C 5/182* (2013.01); *F25C 2305/00* (2013.01); *F25C 2500/02* (2013.01)

(58) Field of Classification Search
CPC ..... F25C 5/04; F25C 5/08; F25C 5/18; F25C 5/182; F25C 2305/00; F25C 2305/022; F25C 2500/02; F25C 1/24; F25C 1/243; F25C 1/246; F25D 3/04; F25D 3/045; F25D 3/06; F25D 3/08
USPC ..... 62/66, 71, 344, 459–464, 72, 74, 353, 62/347–348, 356; 249/57, 76, 119, 136, 249/141, 203
See application file for complete search history.

(56) References Cited

U.S. PATENT DOCUMENTS

| | | | | |
|---|---|---|---|---|
| 2,247,018 | A * | 6/1941 | Henning | 249/119 |
| 4,081,122 | A | 3/1978 | Hobson | |
| D249,269 | S | 9/1978 | Pitts | |
| 4,162,780 | A * | 7/1979 | Rankin | 249/127 |
| D255,657 | S | 7/1980 | Florian et al. | |
| 4,244,470 | A * | 1/1981 | Burnham | 206/525 |
| D262,355 | S | 12/1981 | Oakley | |
| 4,417,716 | A * | 11/1983 | Penna et al. | 249/121 |
| 4,910,974 | A * | 3/1990 | Hara | 62/347 |
| 4,970,877 | A * | 11/1990 | Dimijian | 62/344 |
| D406,595 | S | 3/1999 | Tunzi | |
| 6,168,131 | B1 | 1/2001 | Tabatabaie | |
| 6,217,092 | B1 * | 4/2001 | Spicker | 294/16 |
| 6,857,277 | B2 * | 2/2005 | Somura | F25C 1/22 249/92 |
| 2004/0206250 | A1 * | 10/2004 | Kondou et al. | 99/426 |
| 2005/0151050 | A1 * | 7/2005 | Godfrey | 249/127 |
| 2009/0178428 | A1 * | 7/2009 | Cho et al. | 62/344 |

OTHER PUBLICATIONS

Maynard, Nora—2 Spherical Ice Makers: MoMA vs. MUJI (+ Expert Tips)—p. 1/3—Apr. 1, 2011.*

* cited by examiner

*Primary Examiner* — Cheryl J. Tyler
*Assistant Examiner* — Jose O Class-Quinones

(57) ABSTRACT

An ice support and storage tray includes one or more cavities having upwardly facing spherical surface portions that support spherical pieces of ice. The tray is preferably made of a material having a low thermal conductivity to reduce melting of the spherical pieces of ice. The spherical support surfaces minimize melting points that could otherwise cause the spherical pieces of ice to melt and develop irregular surface shapes. The ice tray may be used in a freezer having an ice maker that transports spheres of ice to the ice support cavities. The ice storage tray may be configured to permit removal of spheres of ice without tipping the tray upside down and/or twisting/deforming the tray.

17 Claims, 6 Drawing Sheets

ICE STORAGE TO HOLD ICE AND MINIMIZE MELTING OF ICE SPHERES

BACKGROUND OF THE INVENTION

Various types of ice makers have been developed. Known ice makers may make ice "cubes" in the form of cubes or other shapes. However, if the ice cubes are stored together in a box-like tray or the like, the shape of the "cubes" may change due to melting of portions of the ice cubes.

SUMMARY OF THE INVENTION

One aspect of the present invention is a method of storing spherical pieces of ice. The method includes providing a freezer having a refrigerated space that can be maintained at a temperature below the freezing point of water. The method also includes providing an ice maker configured to produce a plurality of spherical pieces of ice, each spherical piece of ice having a substantially spherical outer surface defining a first radius. The method includes providing a tray having a plurality of upwardly opening ice supporting cavities, wherein each ice support cavity has a concave surface defining a portion of a sphere having a second radius that is substantially equal to the first radius whereby spherical pieces of ice formed by the ice maker fit closely in the ice support cavities. The method further includes positioning the tray in the refrigerated space at a predefined location relative to the ice maker. Pieces of ice are transported from the ice maker to the ice support cavities, and the pieces of ice are positioned in the ice support cavities.

These and other features, advantages, and objects of the present invention will be further understood and appreciated by those skilled in the art by reference to the following specification, claims, and appended drawings.

DETAILED DESCRIPTION

Figure 1:
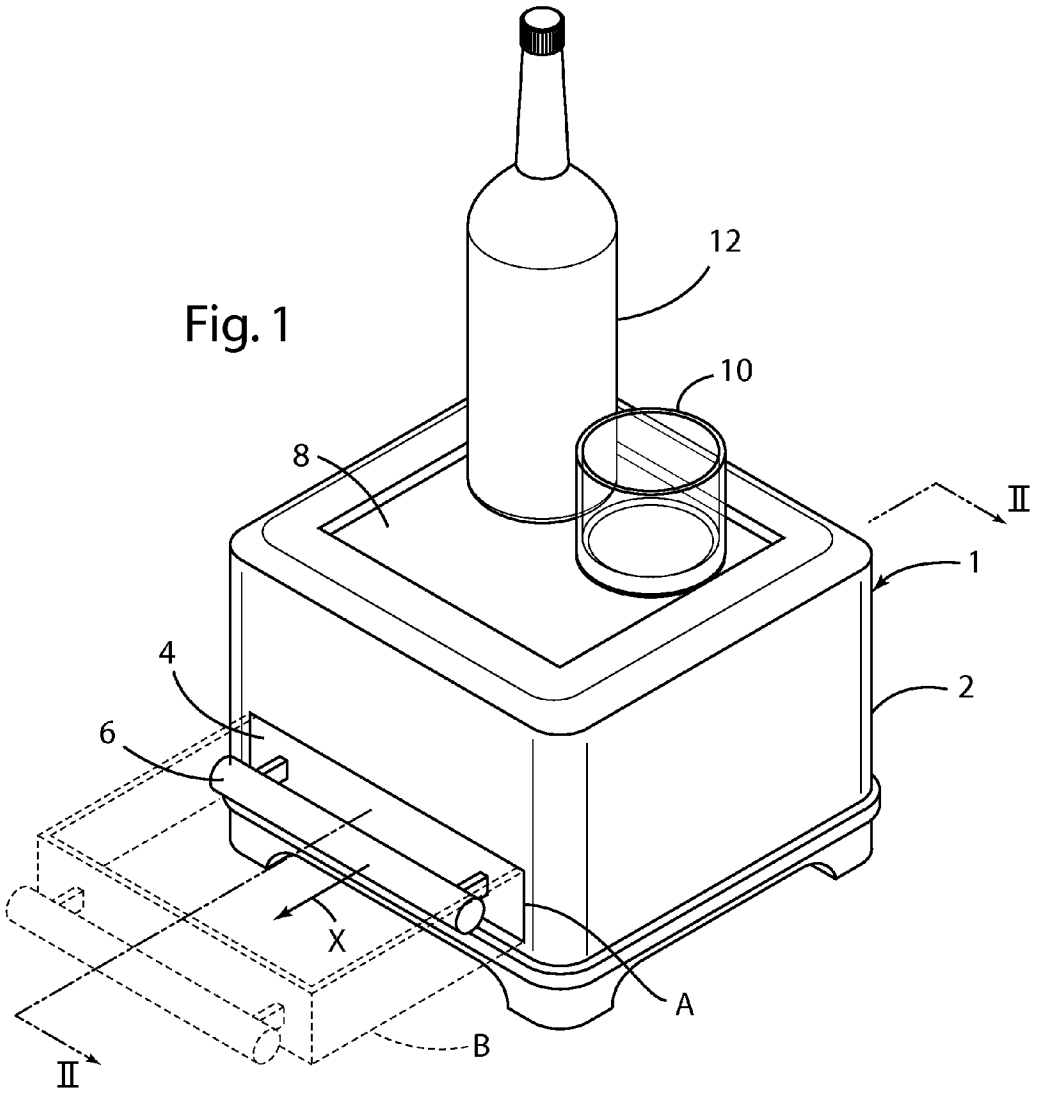
FIG. 1 is an isometric view of an ice maker including an ice tray according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, an ice maker 1 according to one aspect of the present invention includes a housing 2 and a drawer 4 that may be moved between a closed position "A" and an open position "B." The drawer 4 may include a handle 6 that can be grasped by a user to thereby shift the drawer 4 from the closed position A to the open position B as shown by the arrow "X." In the illustrated example, the ice maker 1 is a relatively compact unit that can be positioned on a counter top or the like. The ice maker one may include an upper surface 8 that is configured to support glasses 10, bottles 12, and other such items.

Figure 2:
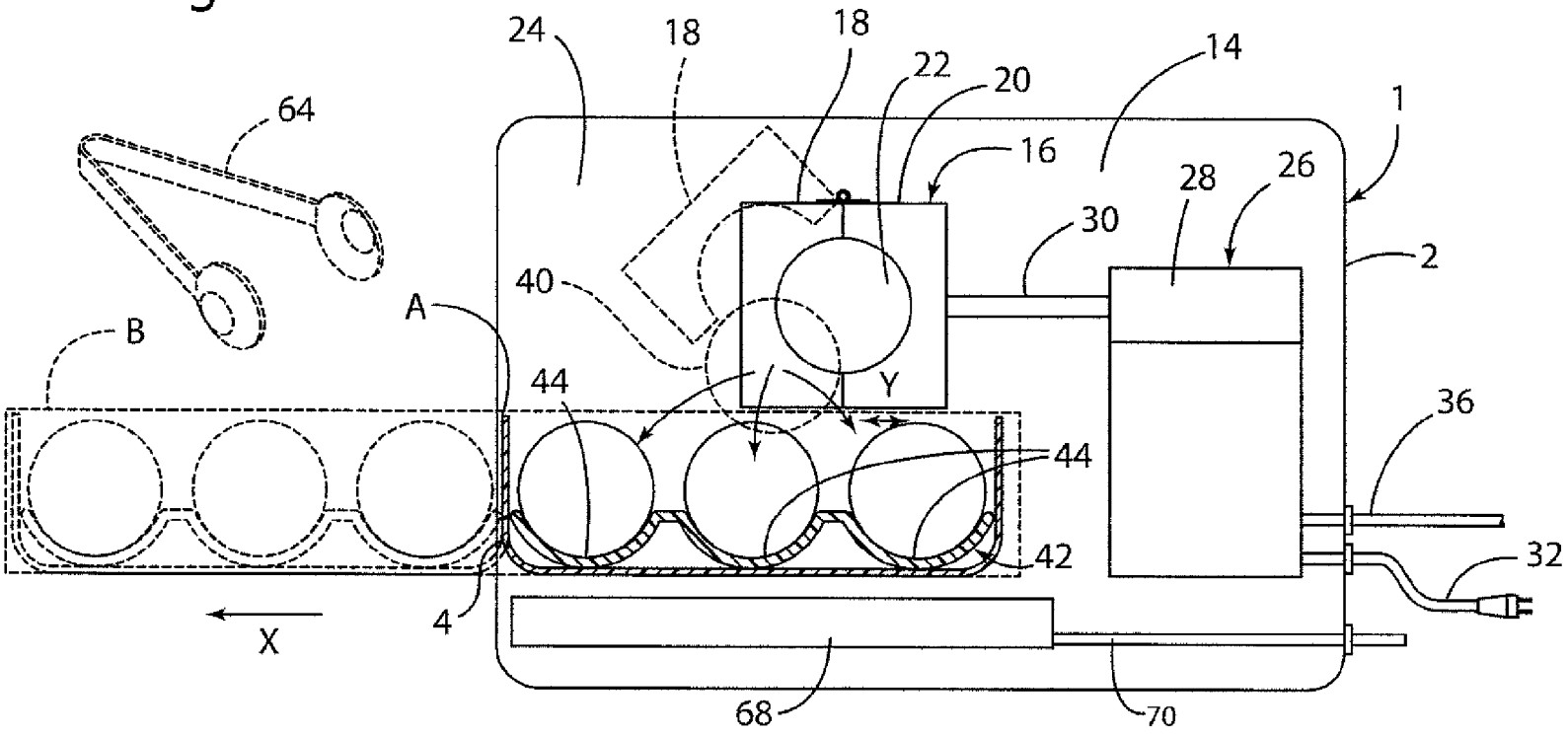
FIG. 2 is a cross sectional view of the ice maker of FIG. 1 taken along the line II-II.

With further reference to FIG. 2, housing 2 defines an internal cavity 14. An ice maker 16 includes first and second mold parts 18 and 20 that together define a spherical cavity 22 when the mold parts 18 and 20 are in a closed position relative to one another. Ice maker 1 may include an insulated refrigerator compartment 24 that is cooled by a refrigeration unit 26 disposed within housing 2. Refrigeration unit 26 may comprise a conventional refrigeration unit having a compressor, an evaporator, and a condenser, or it may comprise other suitable refrigeration systems. Alternatively a thermoelectric or other cooling source may be used. In other cases, it may be desirable to keep the temperature near but above freezing to avoid frost buildup in housing 2 or on the ice made. This may be done by driving a cooling source, such as the refrigeration unit 26, a thermoelectric or other cool sourcing, the ice mold itself, the created ice pieces or a combination thereof. For example it may be preferable to keep the temperature during storage of ice spheres between 32 degrees and 50 degrees Fahrenheit, or even more preferable to maintain it between 34 and 45 degrees Fahrenheit or at some other similar range.

Refrigeration unit 26 includes a water supply unit 28 that may supply water to the cavity 22 through a conduit 30. The refrigeration unit 26 may be connected to a power supply utilizing a conventional power cord and plug 32. The refrigeration unit 26 may also be connected to a water source utilizing a fluid conduit 36.

In use, water is supplied to the spherical cavity 22 with the mold parts 18 and 20 in the closed position. After the ice freezes to form a spherical piece of ice 40, one of the mold parts 18 shifts to an open position, thereby permitting a spherical piece of ice 40 to drop into an ice support cavity 44 of an ice tray 42. The ice maker 16 may include a single spherical cavity 22 that produces one spherical piece of ice 40 at a time. Alternatively, the ice maker 16 may include a plurality of spherical cavities 22 that simultaneously produce a plurality of spherical ice pieces 40. For example, with reference to FIG. 3, ice maker 16 may include four spherical cavities 22 to produce four spherical pieces of ice 40 that drop into a row 46A, 46B, or 46C of ice support cavities 44 of an ice tray 42. It will be understood that the ice maker 16 may comprise a variety of devices capable of making spherical pieces of ice, and the ice maker 16 therefore does not necessarily comprise mold parts 18 and 20 as shown in FIG. 2.

In the illustrated example, the spherical pieces of ice 40 are positioned directly above ice support cavities 44 at the time they are released from the mold parts 18 and 20. The spherical pieces of ice therefore drop directly into the ice support cavities 44, This dropping transports the spherical pieces of ice 40 from the ice maker 16 to the cavities 44 of tray 42. The mold parts 18 and 20 may be shifted fore and aft in the direction of the arrow "V" (FIG. 2) to align the mold parts 18 and 20 above a specific row 46A, 46B, or 46C of tray 42 prior to opening of mold part 18. Refrigeration unit 26 may include a controller that is operably connected to a powered actuator (not shown) to thereby selectively shift the mold parts 18 and 20 in fore-aft directions. The spherical pieces of ice 40 can thereby be dropped into the cavities 44 of a selected row 46A, 46B, or 46C. Alternately, spherical pieces of ice 40 may be transported by rails (not shown) or other suitable devices or structures to transport the spherical pieces of ice 40 from the mold parts 18 and 20 to selected ice support cavities 44.

Figure 3:
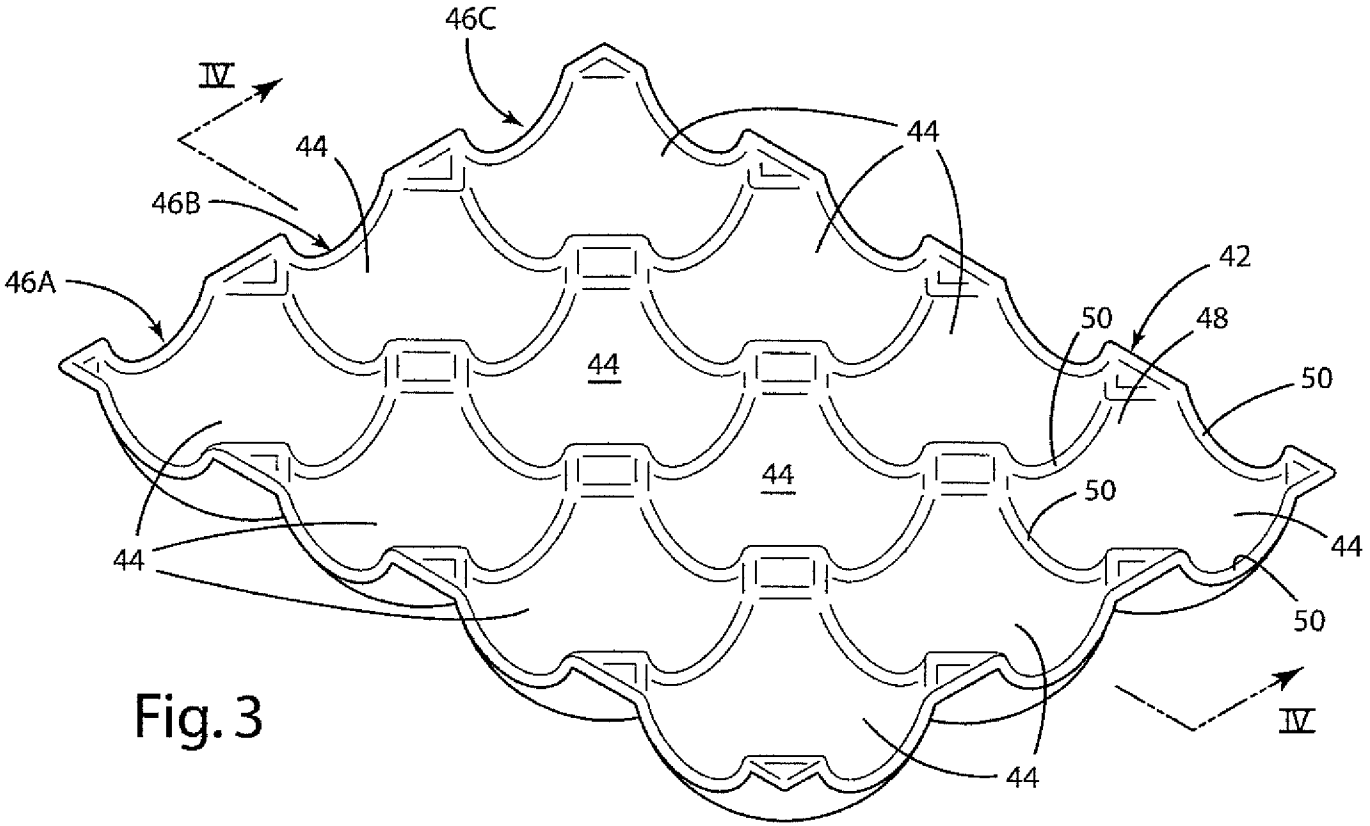
FIG. 3 is an isometric view of an ice tray according to one aspect of the present invention.

With reference to FIG. 3, ice support tray 42 may include a plurality of rows 46A, 46B, and 46C of cavities 44. However, tray 42 could comprise a single row of cavities 44 if required for a particular application. Furthermore, the cavities could be arranged in such a way that rows are not formed. The cavities 44 are defined by concave surfaces 48. The concave surfaces 48 are generally spherical with a radius "R1" (FIG. 4) that is substantially identical to a radius "R2" of spherical pieces of ice 40. Each cavity 44 defines four edges 50 that are formed by upwardly facing concave edge surfaces 52.

Each spherical piece of ice 40 (FIG. 4) defines a radius R1 that is substantially identical to a radius R2 of concave surface 48 of ice support cavities 44. In a preferred embodiment, R1 and R2 are about 25 mm, such that ice spheres 40 have a diameter of about 50 mm. However, it will be understood that the ice spheres 40 (and cavities 44) may be significantly larger or smaller. In general, the ice spheres are preferably about 20 mm to about 80 mm in diameter, but sizes outside this range are also possible.

Referring again to FIG. 4, ice support cavities 44 and spherical pieces of ice 40 define coincident center points "C." The center points C define a horizontal plane "P." The lowermost portions of the concave edge surfaces 52 are spaced downwardly a distance "V" from the plane P. The distance V is preferably at least about one third or one half of the radius R1 (or R2). The side portions 54 of spherical pieces of ice 40 project sidewardly somewhat, thereby exposing a surface portion 56 of each spherical piece of ice 40 that is below the center plane P. Surface portions 56 face outwardly and downwardly. The surface 56 can therefore be grasped by a user to enable the user to pull the individual spherical pieces of ice 40 upwardly out of cavities 44.

Figure 5:
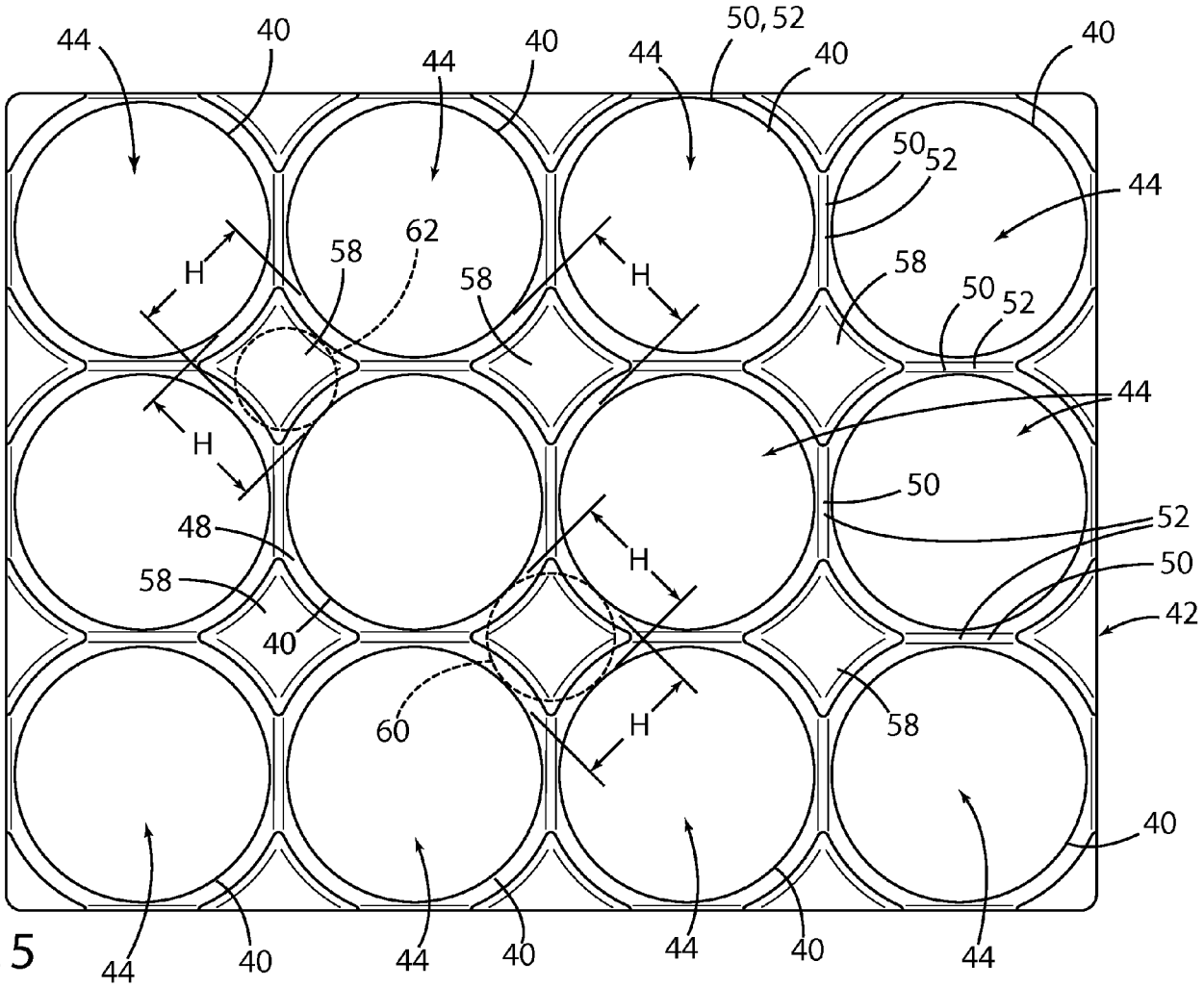
FIG. 5 is a plan view of the ice tray of FIG. 3.

Also, with further reference to FIG. 5, adjacent spherical pieces of ice 40 are spaced apart a diagonal distance "H," where the distance H is measured directly above surfaces 58. Surfaces 58 of tray 24 are generally planar, upwardly-facing surfaces that are disposed at the centers of four adjacent cavities 44. The distance H is preferably large enough to permit a user's thumb 60 and fingers to be inserted for grasping spherical pieces of ice 40. The distance H is preferably about 20 mm or greater, and more preferably 25 mm or more to provide clearance for a user's fingers. Tongs 64 or other suitable implement may be utilized to contact surface 56 to permit removal of spherical pieces of ice 40. This permits the tray 42 to remain in drawer 4 during removal of spherical pieces of ice 40. Thus, in contrast to known trays that are used to form ice cubes, the storage tray 42 does not necessarily need to be tipped over to remove spheres of ice 40.

Figure 4:
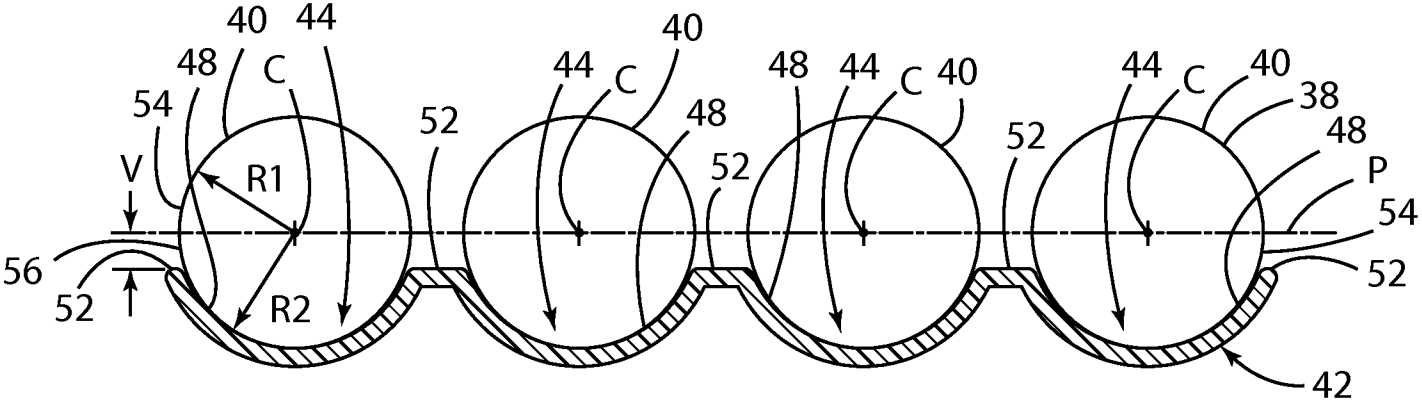
FIG. 4 is a cross sectional view of the ice tray of FIG. 3 taken along the line IV-IV.
Figure 6:
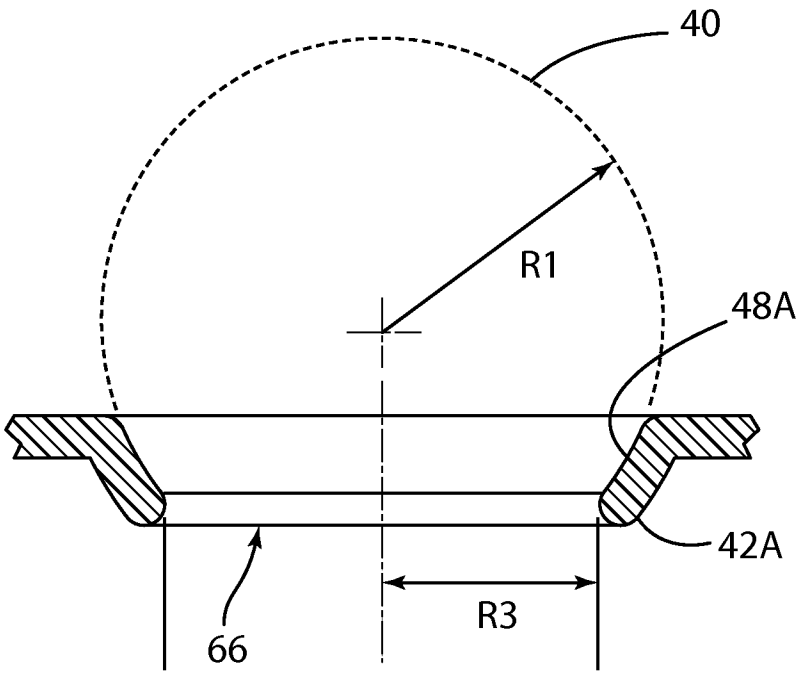
FIG. 6 is a partially fragmentary cross sectional view of an ice tray according to another aspect of the present disclosure.

With further reference to FIG. 6, a tray 42A according to another aspect of the present disclosure is similar to the tray 42 of FIGS. 3-5. However, tray 42A includes an opening 66 having a radius R3. Radius R3 is somewhat smaller than the radii R1 and R2. For example, if R1 and R2 are 25 mm, R3 may be 20 mm.

As ice sphere 40 melts, liquid water flows out of opening 66 and drips or flows into a water recovery area such as bin 68 (FIG. 2) positioned below tray 42. Removal of melted water from cavity 44A reduces heat transfer from ice spheres 40 into the liquid water and thereby slows down the melting of ice spheres 40. A drain line 70 may be connected to bin 68 to provide for drainage of water from bin 68. Referring again to FIG. 6, as ice sphere 40 melts, the size of the ice sphere 40 is gradually reduced. The ice sphere 40 eventually falls through opening 66 and into bin 68 (FIG. 2). This automatically clears the cavities 44A. Ice maker 16 may be operably connected to a switch or other sensor (not shown) whereby the ice maker is actuated and makes new ice spheres 40 once the melted spheres 40 have dropped into bin 68.

The ice storage tray 42 is preferably made of a material having relatively low thermal conduction to thereby prevent or reduce transfer of heat from the spherical pieces of ice 40 in a manner that could otherwise cause portions of the spherical surface 38 pieces of ice 40 to melt. In a preferred embodiment, storage tray 42 is made of a polymer material having a thermal conductivity of about 2 W/° Cm. The tray 42 may also comprise a material having an even lower thermal conductivity of about 0.1 W/° Cm or less. Because the ice support cavities 44 have a concave spherical surface 48 that contacts the outer surface 38 of spherical pieces of ice 40, the spherical pieces of ice 40 do not develop irregularities in areas of contact that could otherwise occur if the support cavities 44 had a non spherical surface shape.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A method of storing spherical pieces of ice in a freezer, the method comprising:

providing an ice maker configured to produce a plurality of spherical pieces of ice, each spherical piece of ice having a substantially spherical outer surface defining a first radius;

providing a tray having a plurality of upwardly opening ice support cavities, wherein each ice support cavity has a concave surface defining a portion of a sphere having a second radius that is substantially equal to the first radius whereby the spherical pieces of ice formed by the ice maker fit closely in a respective one of the ice support cavities;

positioning the tray in a refrigerated space at a predefined location relative to the ice maker;

transporting the spherical pieces of ice from the ice maker to a respective one of the ice support cavities;

positioning the spherical pieces of ice in the ice support cavities; and wherein:

each concave surface is truncated to define an opening in each of the concave surfaces; each of the openings having a third radius that is smaller than both the first and second radii, wherein the spherical ice pieces fall through a respective one of the openings after the spherical ice pieces melt and shrink in size.

2. The method of claim 1, wherein:

the fallen ice pieces are received into a water recovery area.

3. The method of claim 1, wherein:

the tray comprises a material having thermal conductivity of 2 WrCm or less.

4. The method of claim 1 , further providing:

the refrigerated space can be maintained at a temperature above but within 15 degrees Fahrenheit of the freezing point of water.

5. The method of claim 1, wherein:

a respective one of the respective ice support cavities are arranged in a plurality of parallel rows.

6. The method of claim 1, wherein:

the freezer comprises a housing and a drawer that is movably supported by the housing; and including:

positioning the tray in the drawer whereby the drawer can be moved from a closed position to an open position to permit user access to ice spheres disposed in a respective one of the ice support cavities of the tray.

7. The method of claim 6, including:

positioning the tray below the ice maker;

causing ice spheres made by the ice maker to drop into a respective one of the ice support cavities.

8. The method of claim 7, wherein:

positioning the tray below the ice maker includes shifting the drawer from an open position to a closed position.

9. The method of claim 1, wherein:

each ice support cavity defines a center point, and the concave surfaces of each ice support cavity define edges having portions that are spaced downwardly a distance that is at least about one third of the first radius relative to a horizontal plane passing through the center point of each ice support cavity whereby surface portions of the spherical pieces of ice below the horizontal plane are exposed when the spherical pieces of ice are positioned in the ice support cavities; and including:

removing the spherical pieces of ice by gripping the surface portions of the spherical pieces of ice that are below the horizontal planes, and lifting the spherical pieces of ice out of a respective one of the ice support cavities.

10. The method of claim 9, wherein:

gripping the spherical pieces of ice includes grasping the spherical pieces of ice by hand.

11. The method of claim 9, wherein:

gripping the spherical pieces of ice includes bringing opposed contact surfaces of a mechanical device into contact with the spherical pieces of ice while the spherical pieces of ice are disposed in a respective one of the ice support cavities.

12. A method of forming and storing spherical pieces of ice, the method comprising:

providing an ice maker having a mold with first and second mold parts having concave surfaces that together define at least one spherical cavity when the first and second mold parts are in a closed position relative to one another;

introducing water into the at least one spherical cavity;

freezing the water in the spherical cavity to produce at least one spherical piece of ice having a substantially spherical outer surface defining a first radius;

providing a tray having at least one upwardly opening ice support cavity;

wherein the at least one ice support cavity has a concave surface defining a portion of a sphere having a second radius that is substantially equal to the first radius;

positioning the tray in a refrigerated space adjacent the ice maker;

shifting the first mold part to an open position, thereby permitting the at least one spherical piece of ice to be removed from the mold; and positioning the spherical piece of ice in the at least one ice support cavity; wherein the at least one ice support cavity of the tray has an opening at a lower portion of the at least one ice support cavity such that liquid water in the at least one ice support cavity drains out of the at least one ice support cavity.

13. The method of claim 12, wherein:

the tray includes a plurality of ice support cavities that are arranged in a plurality of parallel rows.

14. A method of storing spherical pieces of ice in a freezer, the method comprising:

providing an ice maker configured to produce a plurality of spherical pieces of ice;

providing a tray having a plurality of upwardly opening ice support cavities, wherein each ice support cavity has an opening at a lower portion of each ice support cavity such that liquid water flows out of each of the ice support cavities through the respective openings;

positioning the tray in a refrigerated space at a predefined location relative to the ice maker;

transporting spherical pieces of ice from the ice maker to each ice support cavity;

positioning the spherical pieces of ice in each ice support cavity.

15. The method of claim 14, wherein:

each spherical piece of ice has a substantially spherical outer surface defining a first radius; and:

each ice support cavity has a concave surface defining a portion of a sphere having a second radius that is substantially equal to the first radius whereby each spherical piece of ice formed by the ice maker fits closely in each ice support cavity.

16. The method of claim 15, wherein:

the ice support cavities are arranged in a plurality of parallel rows.

17. The method of claim 14, wherein:

the freezer comprises a housing and a drawer that is movably supported by the housing; and including:

positioning the tray in the drawer whereby the drawer can be moved from a closed position to an open position to permit user access to ice spheres disposed in the ice support cavities of the tray.

* * * * *